US006668974B1

(12) United States Patent
Mottelet et al.

(10) Patent No.: US 6,668,974 B1
(45) Date of Patent: Dec. 30, 2003

(54) PARTITIONED WAVE-GUIDE SOUND INSULATION GLAZING

(75) Inventors: Beatrice Mottelet, Compiegne (FR); Marc Rehfeld, Ezanville (FR)

(73) Assignee: Saint-Gobain Glass France, Courbevoie (FR)

( * ) Notice: Subject to any disclaimer, the term of this patent is extended or adjusted under 35 U.S.C. 154(b) by 34 days.

(21) Appl. No.: 10/009,440

(22) PCT Filed: May 31, 2000

(86) PCT No.: PCT/FR00/01501

§ 371 (c)(1),
(2), (4) Date: Apr. 11, 2002

(87) PCT Pub. No.: WO00/75473

PCT Pub. Date: Dec. 14, 2000

(65) Prior Publication Data

(65)

(30) Foreign Application Priority Data

Jun. 8, 1999 (FR) ..... 99 07220

(51) Int. Cl.[7] ..... E06B 3/00

(52) U.S. Cl. ..... 181/284; 181/289; 52/144; 52/786.13

(58) Field of Search ..... 52/144, 786.13, 52/795.1, 786.1, 786.11, 786.12; 181/198, 206, 289, 290, 284

(56) References Cited

U.S. PATENT DOCUMENTS 3,866,001 A * 2/1975 Kleinschmidt et al. ..... 181/285
3,899,861 A * 8/1975 Brown ..... 52/786.1
4,114,342 A * 9/1978 Okawa ..... 52/786.13
5,087,489 A * 2/1992 Lingemann ..... 428/34
5,088,258 A * 2/1992 Schield et al. ..... 52/204.593
5,094,055 A * 3/1992 Berdan ..... 52/204.591
5,244,709 A * 9/1993 Vanderstukken ..... 428/99
5,290,611 A * 3/1994 Taylor ..... 428/34
5,452,362 A * 9/1995 Burward-Hoy ..... 381/71.5
5,508,477 A * 4/1996 Kato et al. ..... 181/205
5,598,669 A * 2/1997 Hamdi et al. ..... 52/144

FOREIGN PATENT DOCUMENTS

DE 28 03 740 8/1979
WO 85 02640 6/1985

* cited by examiner

*Primary Examiner*—Robert Nappi
*Assistant Examiner*—David Warren
(74) *Attorney, Agent, or Firm*—Oblon, Spivak, McClelland, Maier & Neustadt, P.C.

(57) ABSTRACT

The invention relates to an acoustic insulating glazing unit.

This glazing unit comprises two glass sheets (12, 14) joined together around their periphery by means of an assembly (16) forming a seal ($\mathbf{16_3}$) and an insert frame ($\mathbf{16_1}$) which defines, with the two glass sheets, a flat cavity filled with a gas, and a waveguide fastened between the glass sheets, internal to the insert frame. The waveguide consists of at least one straight tubular section (20, 22, 24, 26) placed on the periphery of the gas-filled cavity along one side of the glazing unit, this section being provided with a transverse partition (28) which closes the latter in its length direction, the said partition being placed at a length position along the section which depends on the acoustic mode of the cavity that it is desired to disorganize, this partition defining, on either side of it, two chambers (30, 31) which communicate with the cavity through the ends of the sections.

13 Claims, 3 Drawing Sheets

PARTITIONED WAVE-GUIDE SOUND INSULATION GLAZING

The present invention relates to the acoustic insulation of a glazing unit.

It is common practice in the building industry to use insulating glazing units for improving the thermal insulation of rooms. The glazing units generally comprise two glass sheets combined by means of an insert frame which keeps them at a certain distance apart, while trapping an air or gas layer between them. For example, the glass sheets may have a thickness of 4 mm and be separated by an air or gas space generally of between 6 and 24 mm in thickness. However, as constructed, the acoustic performance of these glazing units is limited, it being appreciably inferior to that of a monolithic glass pane of the same overall mass per unit area and, in particular, the acoustic performance of double-glazing units having 4 mm sheets is mediocre.

Various means are used in the industry to improve the acoustic performance of these insulating glazing units. The means most commonly employed consists in increasing the thickness of the glass sheets, but the effectiveness of this technique is limited and it increases the weight of the glazing unit.

Another means consists in increasing the thickness of the air layer, but the effect is appreciable only for air thicknesses of several centimetres, something which prevents sealed insulating glazing units to be produced.

Patent EP 0,100,701 teaches a glazing unit whose glass sheets are formed by special laminations incorporating special polymer films. This type of glazing unit results in a very substantial improvement over the ordinary insulating glazing unit but the cost of manufacturing it is also considerably higher.

Some publications have proposed glazing units formed from monolithic glass sheets of standard thickness, outside which are fitted Helmholtz resonators tuned to the resonant frequency of the air layer trapped between the glass sheets to which the said resonators are connected. It will be recalled that a Helmholtz resonator consists of a cavity which communicates with the outside via a narrow orifice. When an acoustic pressure acts on the said orifice, it tends to make the mass of air contained in the cavity vibrate at a certain frequency which is a function of the dimensions of this cavity. The Helmholtz resonator is used to attenuate the low-frequency oscillations; its efficiency is at a maximum around its acoustic resonant frequency and around its harmonics.

An example of this technique is described in Patent Application WO-A-85/02640. This application relates to a box fitted with spherical Helmholtz resonators located outside the box and communicating with its internal cavity via ducts of small cross section. However, this system is completely unsuitable for insulating glazing units since external spherical resonators are expensive to produce and difficult to implement. In addition, these resonators are relatively bulky compared with the volume of the air layer of the glazing unit and therefore would result in a large assembly.

Patent DE 3,401,996 relates to a variant of the above system, applied to a glazing unit, which uses a single Helmholtz resonator, again outside the glazing unit, mounted on its periphery, the cavity of the resonator communicating with the air layer via a continuous slot, but this system has the same drawback as the previous one.

Finally, Patent EP 0,579,542 teaches a glazing unit fitted around its periphery with a waveguide which communicates with the air layer via several orifices whose shape, cross section and position are determined so as to detune the acoustic and mechanical waves which are created in the air layer and on the glass sheets, respectively, when the glazing unit is exposed to an incident acoustic field.

This waveguide is formed by a single section going around the insulating glazing unit, placed along the sides of the insert frame, internally with respect to this frame, with holes preferably in the middle of the sides in order to ensure communication between the inside of the waveguide and the air layer. In another embodiment, this waveguide is formed from several straight sections whose ends are not touching, thus leaving additional communication passages between the inside of the waveguide and the air layer.

Whatever the embodiment, the acoustic performance is quite limited and it is complicated to fit the waveguide section or sections.

The present invention aims to remedy the drawbacks of the prior art presented above and its subject is an acoustic insulating glazing unit formed from two glass sheets, which are monolithic or otherwise, having improved acoustic efficiency, leaving a large daylight, being more compact and being easy to manufacture, and for a cost barely greater than that of conventional insulating glazing units.

The invention is based on the observation that a glazing unit which is formed from two glass sheets and is exposed to an incident acoustic excitation is the seat of several vibroacoustic modes but that one of the acoustic modes which carries the most energy from one sheet to the other is the $\lambda/2$ mode. Therefore, if this $\lambda/2$ mode is essentially attenuated, most of the acoustic energy transmitted from one glass pane to the other is eliminated.

The invention relates to an acoustic insulating glazing unit of the type described in Patent EP 0,579,542, that is to say formed from two glass sheets separated by a peripheral insert frame, containing a cavity filled with gas, especially most often air, and having an internal waveguide, characterized in that this waveguide consists of at least one straight tubular section placed on the periphery of the cavity, along one side of the glazing unit, this section being provided with a transverse partition which closes the latter along its length direction and is placed at a point along this length which depends on the acoustic mode that it is desired to attenuate.

Thus, the glazing unit is combined with a double tubular Helmholtz resonator tuned to the wavelength of the acoustic mode that it is desired essentially to disorganize, for example $\lambda/2$ if it is desired to disorganize this vibration mode or $\lambda/i$ (i being an integer) if it is desired to disorganize this other vibration mode. It is known that $\lambda$ is given by the formula $\lambda=c/l$ where c is the speed of sound in the internal cavity of the glazing unit and 1 is the length of the tubular Helmholtz resonator, which depends on the position of the partition.

Advantageously, for greater efficiency, four sections are placed in the cavity, around the periphery of a rectangular insulating glazing unit along the sides of the said glazing unit, each section being provided with a transverse partition.

The position of the partition depends on the acoustic mode to be disorganized: it is placed approximately in the middle of the length of the section in order to act on the $\lambda/2$ mode or one third along the length in order to detune the $\lambda/3$ acoustic mode.

The central partition may be produced by any appropriate means. It may be manufactured with the section when the latter is being extruded or it may be produced subsequently, especially by fitting two sections of lengths slightly less than half the length of one side of the glazing unit onto a partition connector, that is to say a connector provided with a partition, or else, in particular in the case of thermoformable plastic sections, by restricting the cross section and welding, or else a partition may be slid into a smooth section and be fastened therein.

Moreover, it is possible to insert an absorbent material into the waveguides so as to improve their acoustic performance. It is then judicious to use this absorbent instead of a partition and to make it act as a partition. The waveguide will then be performed, for example, by internally smooth tubular sections into which buffers of absorbent material are inserted and positioned at the desired points especially halfway along the length of each section, respectively.

The principle of sections fitted onto a connector which contains a buffer of absorbent material is also a useful practical solution.

The sections forming the waveguide may be separate and in this case their internal chambers defined on either side of the partition communicate with the cavity of the glazing unit through the open ends of the sections which are opposite the partition.

They may also be joined together by means of tubular corner pieces, the legs of which fit into the ends of the sections, an orifice being provided in the corner pieces or in the facing wall of the sections, in order to make the internal space of the sections communicate with the cavity of the glazing unit, in the corners of the glazing unit.

In another embodiment, a frame is produced from a straight hollow section by bending the latter and orifices are created in the corners of the frame, in its wall intended to face the internal cavity of the glazing unit.

The invention will be more clearly understood on reading the description of a few embodiments, with reference to the appended drawings in which.

Figure 2:
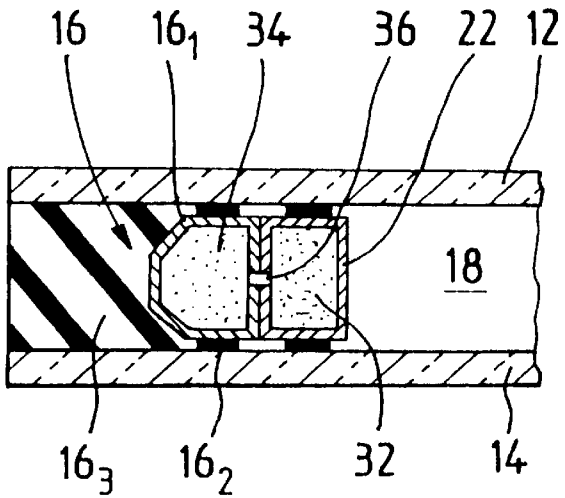
FIG. 2 is a cross-sectional view on a larger scale on the line II—II in FIG. 1.
Figure 1:
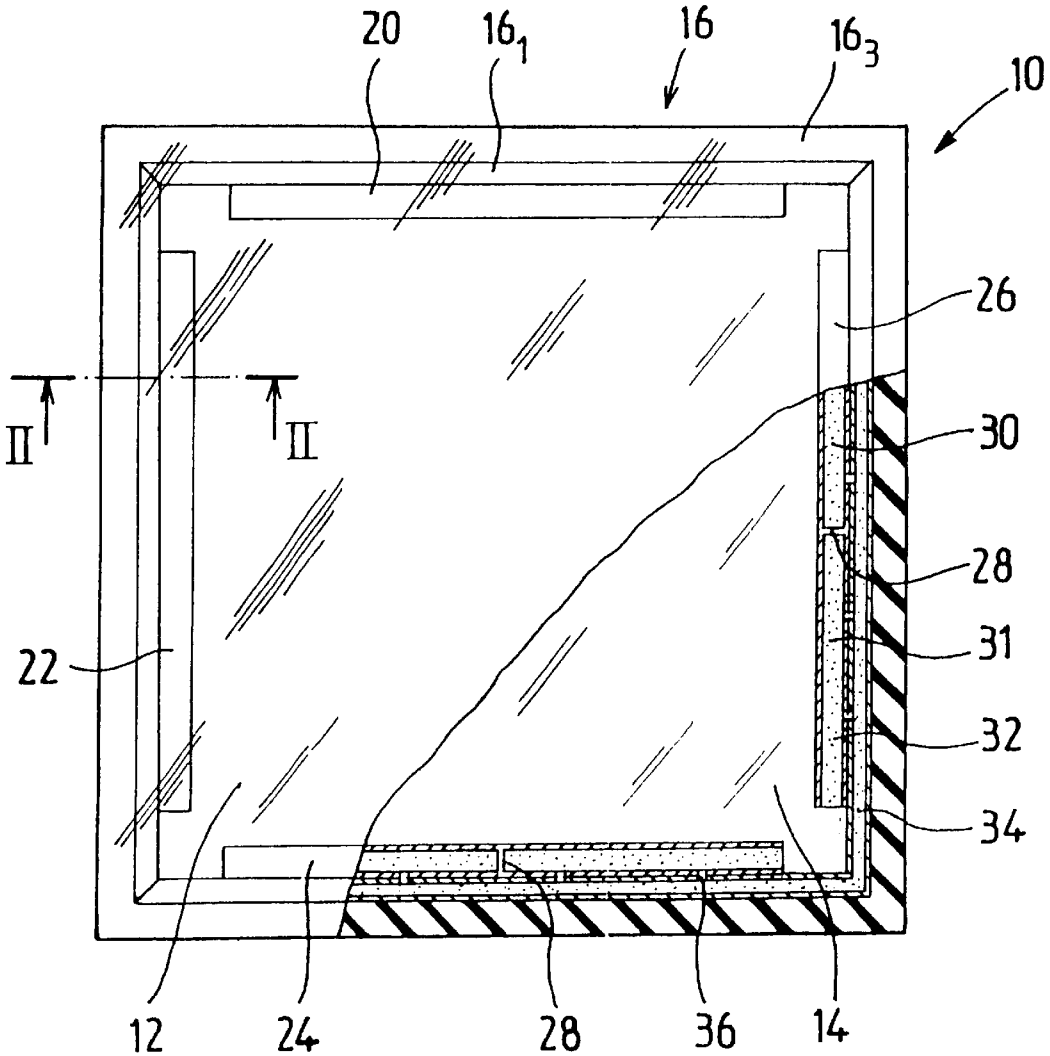
FIG. 1 is a plan view of an acoustic insulating glazing unit according to a first embodiment of the invention, with a cut-away to halfway through the glazing unit.

Firstly, with reference to FIGS. 1 and 2, the glazing unit 10 shown therein comprises, in a manner known per se, two glass sheets 12, 14 connected together over their entire periphery by an assembly comprising a seal and a sealed insert frame which is denoted in its entirety by the reference 16 which keeps them separated while trapping between them a flat cavity 18 that may contain air and/or a gas. This assembly 16 generally comprises a rigid section 16, forming the insert frame adhesively bonded to the sheets 12, 14.

The section $\mathbf{16}_1$ is provided, on each of its lateral faces in contact with the glass sheets, with a bonding and sealing bead $\mathbf{16}_2$ made of butyl rubber and with a peripheral seal $\mathbf{16}_3$ which is adhesively bonded to the internal edges of the two glass sheets 12 and 14.

According to the invention, in order to increase the acoustic insulation of the glazing unit, a waveguide is produced around the latter, inside the assembly 16, which waveguide communicates with the cavity 18 via orifices placed at appropriate points. The waveguide consists of a plurality of straight tubular sections 20, 22, 24, 26 which are adhesively bonded to the two glass sheets and to the inner faces of the assembly 16.

These sections have a rectangular cross section of the same height as the sections forming the insert frame $\mathbf{16}_1$, and are open at their ends. They include, for example halfway along their length, a central partition 28 which defines two chambers 30, 31 on either side of it. These sections are not touching so that the chambers 30, 31 communicate with the cavity 18 through their open ends.

As explained above, such sections with partitions halfway along their length behave as Helmholtz resonators which have the property of disorganizing the $\lambda/2$ acoustic mode which conveys most of the energy of the incident acoustic field.

It is clear that in the case of the rectangular glazing unit of FIG. 1, which uses two pairs of sections of respective lengths L and 1, the waveguide will be able to attenuate the two wavelengths $\lambda_1/2$ and $\lambda_2/2$, $\lambda_1$ and $\lambda_2$ being equal to c/L and c/l respectively.

If it is desired to disorganize other acoustic modes, for example $\lambda/3$, it is at other points along the length of the sections that the partition 28 is placed, for example at one third of the length of the sections 20, 22, 24, 26.

The efficiency of the waveguide may be increased by inserting an acoustically absorbent material 32 into the internal chambers 30, 31.

As is known in the insulating glazing unit field, a desiccant 34 is advantageously placed in the sections forming the insert frame $\mathbf{16}_1$, holes 36, which are drilled in these sections $\mathbf{16}_1$, and terminate inside the sections 20, 22, 24, 26 of the waveguide, bringing this desiccant 34 into communication with the air in the cavity 18 via the waveguide sections 20, 22, 24, 26.

Figure 4:
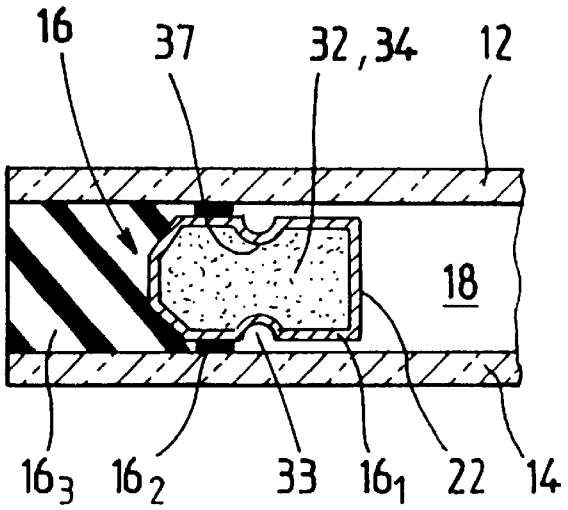
FIG. 4 is a cross-sectional view on the line IV—IV in FIG. 3.
Figure 3:
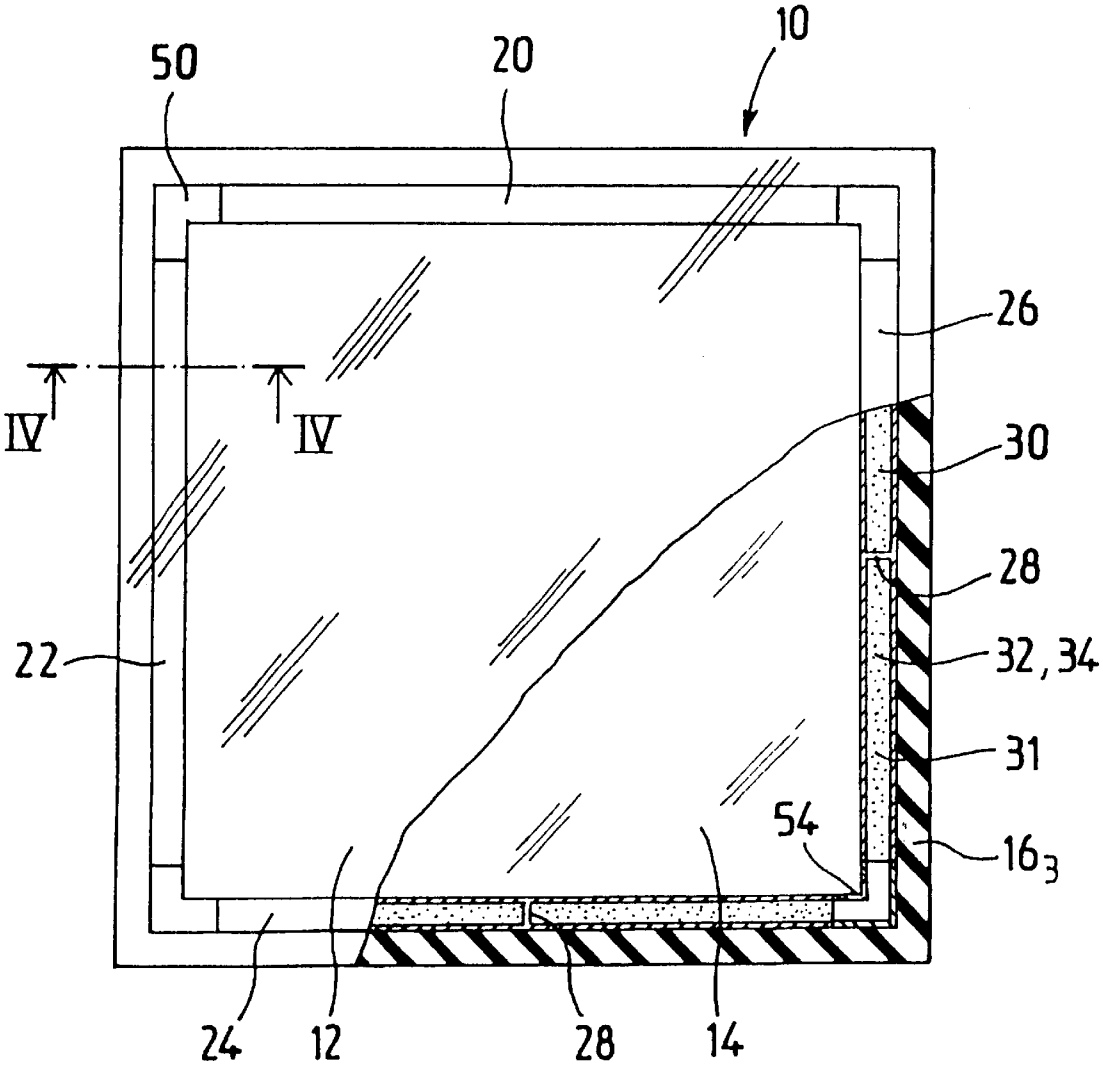
FIG. 3 is a cross-sectional view similar to FIG. 1 of an acoustic insulating glazing unit according to a second embodiment of the invention.

The embodiment illustrated by FIGS. 3 and 4 differs from the previous one only by the fact that the straight tubular sections 20, 22, 24, 26 of the waveguide act at the same time as sections of the rigid insert frame $\mathbf{16}_1$ used for keeping the two glass sheets spaced apart. Thus, the construction of the glazing unit is simpler and the daylight of the said glazing unit is increased.

In this embodiment, as may more particularly be seen in FIG. 4, the butyl rubber beads $\mathbf{16}_2$, which seal against the glass sheets, are deposited on the lateral edges of the waveguide sections while the desiccant 34 and possibly the acoustic absorbent 32 are placed inside these sections.

Advantageously, as shown in FIG. 4, the lateral sides of the tubular sections 20, 22, 24, 26 are provided with longitudinal grooves 33 located between the butyl rubber beads $\mathbf{16}_2$ and the cavity 18. These grooves are capable of acting as a safety reservoir for the butyl rubber or in general for the bonding mastic which could migrate towards the daylight of the cavity 18 under the effect of gravity, the temperature or the vibrations.

Figure 5:
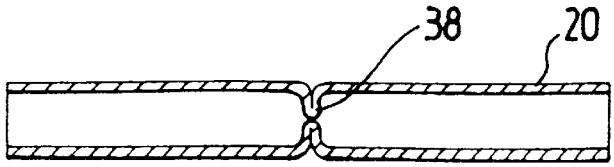
FIGS. 5, 6 and 7 show, in longitudinal section, three embodiments of the central partition in a section.
Figure 6:
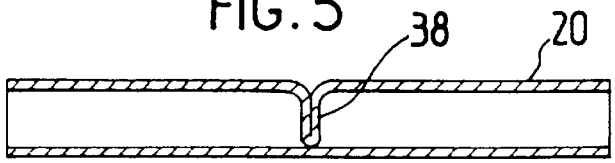
Figure 7:
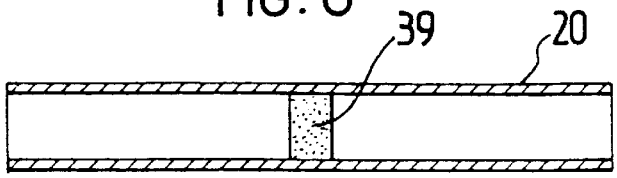

The partition may be produced in various ways, for example it may be formed by a constriction 38 obtained by collapsing two opposed walls of the section (FIG. 5) or a single wall of the section (FIG. 6). This is particularly practical when the sections 20, 22, 24, 26 are made of a thermoplastic; the section is then collapsed and heat-welded. The partition may also be formed by a buffer 39 having a high acoustic absorptivity (FIG. 7).

Figure 8:
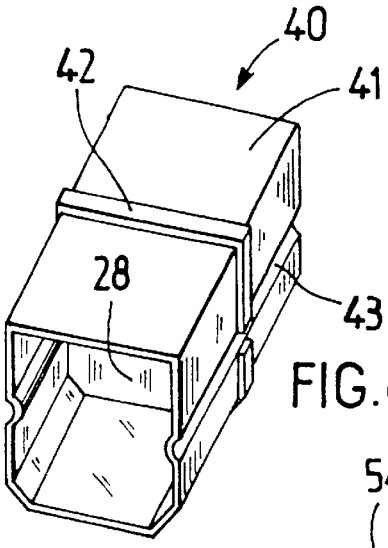
FIG. 8 shows a partition connector.

The partition may also be produced by means of a partition connector 40, as shown in FIG. 8. This connector consists of a portion of tubular section 41 of shorter length, for example approximately 2 to 5 cm, having a slightly smaller cross section than that of the waveguide sections 20, 22, 24, 26 but of the same shape, so as to be able to fit into the latter. It is provided halfway along its length with a partition 28 and, around its periphery, for example vertically in line with the partition 28, with a rib 42 standing out from its surface and having a height equal to the thickness of the walls of the sections 20, 22, 24, 26.

Thus, two section half-lengths fitted onto this connector will in a simple manner constitute a waveguide section having a smooth outer surface, with a partition 28. It will be noted that the acoustic absorbent may also be placed in this connector 40, on each side of the partition 28.

The partition connector shown in FIG. 8 has longitudinal grooves 43 intended to accommodate the ribs 37 which project on the inside of the sections 20, 22, 24, 26.

Figure 9:
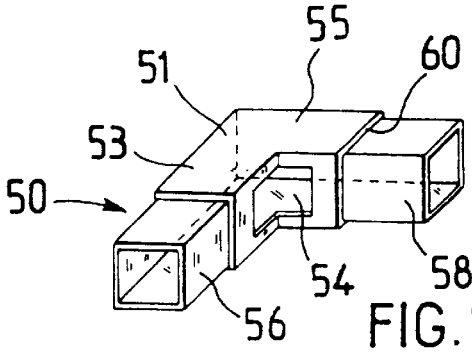
FIG. 9 is a perspective view of a corner piece used for connecting the sections together.

FIG. 9 shows, in perspective, a corner piece 50 used for joining the sections 20, 22, 24, 26 together, in order to make them easier to fit inside the double glazing unit and in particular to ensure continuity and integrity of the insert frame of the double glazing unit in so far as the sections 20, 22, 24, 26, as shown in FIGS. 3 and 4, act at the same time as the Insert frame $\mathbf{16}_1$.

Each corner piece 50 comprises a central body 51 and two legs 53, 55 having the same external cross section as that of the sections. The legs terminate in end-pieces 56, 58 of smaller cross section so as to be able to fit inside the ends of the sections. The corner pieces have, in their internal corner, windows 54 which bring the inside of the waveguide into communication with the cavity 18.

Figure 10:
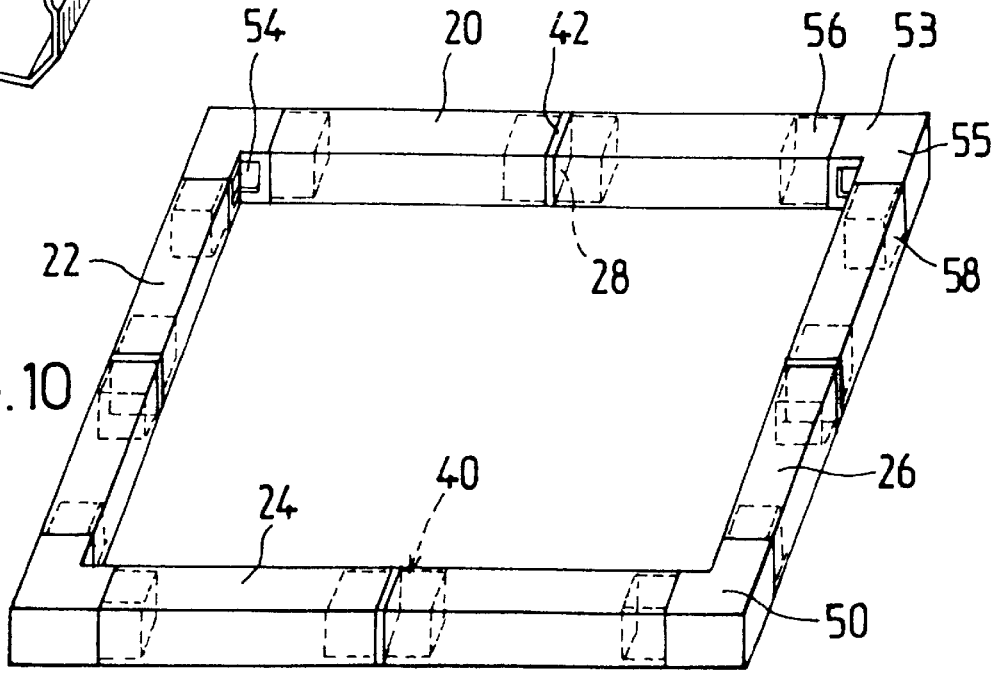
FIG. 10 is a perspective view of a waveguide in the form of a rectangular frame produced by means of sections joined together with the corner pieces of FIG. 9 and the partition connectors of FIG. 8.

A process of manufacture of the acoustic insulating glazing unit in FIG. 3 is carried out as follows: the process starts by forming the four sections 20, 22, 24, 26 by means of the partition connectors 40 and portions of tubular sections that are fitted onto the latter. The absorbent 32 and the desiccant 34 are introduced into the four sections 20, 22, 24, 26 thus formed and then the sections are joined together by means of the corner pieces 50 in order to obtain the frame shown in FIG. 10. The length of the sections will be chosen depending on the dimensions of the glazing unit that it is desired to manufacture. Next, beads $\mathbf{16}_2$ of butyl rubber are deposited on the lateral faces of the insert frame thus formed and then two glass sheets 12, 14 are adhesively bonded to the insert frame. Next, an impermeable plastic bead $\mathbf{16}_3$ is injected into the groove which forms around the periphery of the glazing unit.

It will be noted that the sections are joined together very simply and positively, given that the shoulders 60 defined between the end-pieces 56, 58 and the body 51 of the corner piece limit the insertion length of the end-pieces into the sections to the right value. It will also be noted that the upper and lower faces of the insert frame are flat over their entire area and have no part with an additional thickness. The two glass sheets therefore bear uniformly over the entire area of these faces.

It goes without saying that the waveguide may also be produced when required, as a single piece with the desired dimensions, for example by bending a long tubular section to the shape and dimensions of the glazing unit to be formed and by welding, or joining in another manner, the two ends of the frame thus produced.

Holes are then drilled in the inner corners of this frame in order to connect the inside with the cavity 18. Here again, the partitions 28 will be produced by one of the processes described above, for example by introducing, into the section before it is bent, four absorbent buffers that are positioned so that, after bending, they lie at the middle of the four sides of the waveguide, or else, particularly when the sections are made of thermoplastic, by collapsing the section at the desired points and heat-welding it.

In order to produce the glazing unit of the variant shown in FIGS. 1 and 2, the sections 20, 22, 24, 26 are formed, for example by means of tubes and partition connectors. Next, a bead of butyl rubber is deposited on the lateral faces of each section 20, 22, 24 and 26 thus formed. These sections are then deposited inside a glazing unit under construction and already having its lower glass sheet 12 and its rigid insert frame $\mathbf{16}_1$, adhesively bonded to this sheet 12. When the sections 20, 22, 24, 26 are in place, juxtaposed along the various sides of the insert frame, the glazing unit is closed off by fitting the second glass sheet 14.

Such glazing units according to the invention are particularly effective for air layers from 16 to 24 mm in thickness.

What is claimed is:

1. An acoustic insulating glazing unit comprising:

two glass sheets joined together around their periphery by means of an assembly forming a seal and an insert frame which defines, with the two glass sheets, a flat cavity filled with a gas; and a waveguide fastened between the glass sheets, internal to the insert frame, wherein said waveguide comprises at least one straight tubular section placed on the periphery of the gas-filled cavity along one side of the glazing unit, said section provided with a transverse partition which closes said section in a length direction, said partition placed at a length position along said section which depends on the acoustic mode of the cavity that it is desired to disorganize, said partition defining, on either side, two chambers which communicate with the cavity through an end of said section.

2. The glazing unit according to claim 1, wherein said glazing unit comprises a plurality of waveguide sections placed along a length of one or more sides of the cavity.

3. The glazing unit according to claim 1, wherein the partition of the section is placed approximately halfway along a length of the section.

4. The glazing unit according to claim 1, wherein the partition is placed from one third to one quarter of the way along a length of the section.

5. The glazing unit according to claim 1, wherein the partition is selected from the group consisting of partition connector, a heat-welded constriction in a thermoplastic section, a buffer of acoustically absorbent material slid into the section and a partition slid into the section.

6. The glazing unit according to claim 1, wherein the insert frame of the insulating glazing unit and the at least one waveguide section, is separate and juxtaposed.

7. The glazing unit according to claim 1, wherein the at least one waveguide section acts at the same time as the insert frame.

8. The glazing unit according to claim 1, wherein the at least one waveguide section is provided, along a face in contact with at least one glass sheet, with a longitudinal groove forming a safety reservoir for retaining, in the case of creep, a material which serves to adhesively bond the glass sheets to the insert frame.

9. The glazing unit according to claim 1, wherein a plurality of straight tubular sections are joined together to form a continuous frame having the same shape as the glazing unit, said continuous frame having a plurality of apertures cut into inner corners of said frame in order to make the chambers of the sections communicate with the cavity (18).

10. The glazing unit according to claim 1, wherein a plurality of sections are joined together by a plurality of tubular corner pieces a plurality of the legs of which fit into the ends of the sections, said corner pieces having an orifice at an internal edge in order to make an internal space of the sections communicate with the cavity of the glazing unit.

11. The glazing unit according to claim 9, wherein a plurality of sections are separate and the chambers communicate with the cavity (18) through the open ends of the sections.

12. The glazing unit according to claim 1, wherein the waveguide contains an acoustic absorbent.

13. The glazing unit according to claim 1, comprising four waveguide sections.

* * * * *